US006409034B2

(12) United States Patent
Schorner

(10) Patent No.: US 6,409,034 B2
(45) **Date of Patent: *Jun. 25, 2002**

(54) HINGED CONTAINER CAP

(75) Inventor: Horst Schorner, Keltern-Weiler (DE)

(73) Assignee: Kunststoffwerk Kutterrer GmbH & Co. (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/357,489

(22) Filed: Jul. 20, 1999

(30) Foreign Application Priority Data

Jul. 21, 1998 (DE) ..... 198 32 799

(51) Int. Cl.[7] ..... B25D 39/00

(52) U.S. Cl. ..... 215/237; 215/235; 220/833; 220/838

(58) Field of Search ..... 215/235, 237; 220/837, 838, 847, 281–283, 835, 833, 834; 222/490, 494

(56) References Cited

U.S. PATENT DOCUMENTS

| | | | | |
|---|---|---|---|---|
| 4,173,015 A | * | 10/1979 | Dubach et al. | 220/281 |
| 4,403,712 A | * | 9/1983 | Wiesinger | 220/339 |
| 4,790,442 A | * | 12/1988 | Gach | 215/216 |
| 4,813,560 A | * | 3/1989 | Begley | 215/235 |
| 4,915,268 A | * | 4/1990 | Lay et al. | 222/498 |
| 5,205,431 A | * | 4/1993 | Zinnbauer | 220/283 |
| 5,207,657 A | * | 5/1993 | Gibilisco | 604/295 |
| 5,234,138 A | * | 8/1993 | DeLaforcade | 222/490 |
| 5,358,130 A | * | 10/1994 | Mengeu et al. | 215/238 |
| 5,582,314 A | * | 12/1996 | Quinn et al. | 220/326 |
| 5,588,546 A | * | 12/1996 | Farside | 215/237 |
| 5,642,824 A | * | 7/1997 | Hess, II et al. | 215/235 |
| 5,682,910 A | * | 11/1997 | Kizawa et al. | 220/326 |
| 5,699,912 A | * | 12/1997 | Ishikawa et al. | 206/494 |
| 5,735,418 A | * | 4/1998 | Erb et al. | 215/237 |
| 5,743,443 A | * | 4/1998 | Hins | 222/490 |
| 5,865,353 A | * | 2/1999 | Baudin | 222/546 |
| 5,887,736 A | * | 3/1999 | Mar | 215/237 |
| 5,927,566 A | * | 7/1999 | Mueller | 222/490 |
| 5,996,859 A | * | 12/1999 | Beck | 222/556 |
| 6,003,712 A | * | 12/1999 | Mogard et al. | 220/257 |
| 6,039,197 A | * | 3/2000 | Braun | 215/228 |
| 6,050,434 A | * | 4/2000 | McNab | 215/235 |
| 6,056,142 A | * | 5/2000 | Elliott | 220/278 |
| 6,089,411 A | * | 7/2000 | Baudin et al. | 222/490 |

FOREIGN PATENT DOCUMENTS

EP 743259 * 11/1996

* cited by examiner

*Primary Examiner*—Stephen P. Garbe
*Assistant Examiner*—Joseph C. Merck
(74) *Attorney, Agent, or Firm*—James J. Murphy, Esq.; Winstead Sechrest & Minick

(57) ABSTRACT

A hinged cap with a cap body having a raised portion with an outlet opening in its upper boundary wall, a hinged lid connected via a hinge to said cap body, and a locking arrangement formed on cap body and on hinged lid. At least the raised portion is formed of an elastically deformable material, and the hinged lid positions tight against at least the lip of the outlet opening in a closed position, exerting pressure on the raised portion in the direction of closure. An element formed of an elastically deformable material is provided on the hinged connection which generates a biasing between the cap body and the hinged lid in order to bring the hinged lid into an opened position.

15 Claims, 6 Drawing Sheets

HINGED CONTAINER CAP

FIELD OF THE INVENTION

The present invention relates to a hinged cap with a cap body designed for fitting with a leakproof seal on a container opening, its upper boundary wall having a raised portion with an outlet opening disposed therein for the medium contained within the container receptacle, a hinged lid joined to the cap body for closing the outlet opening, and a locking arrangement formed on the cap body and on the hinged lid.

BACKGROUND

A plurality of receptacle or container cap lids in all manner of various designs is known, especially for glass or plastic bottle receptacles which contain, for example, shower gels, hair shampoos, suncreams or sun lotions and body oils. Similar receptacles may also hold liquid or pasty foods such as mayonnaise, mustard or ketchup, as well as other kinds of fluid-based substances available on the market. The purpose of these cap lids is, on the one hand, to form as leakproof of a seal for the contents within the receptacle as possible, so that the substance contained within does not escape and so that outside air does not constantly pervade the receptacle. On the other hand, such a cap lid should be easy to open and close.

Caps of this type usually have an essentially cylindrically shaped cap body with a female thread provided on its inner wall for screwing onto, for example, an accordingly configured (male) thread at the upper end of a bottle neck. By means of a sealing arrangement, a leakproof connection is created between the cap and the receptacle. The outlet opening for the substance contained within the receptacle is arranged at the upper boundary wall of the cap body essentially in the middle of the bottle opening and is usually restricted in relation to the upper boundary wall by a raised lip. The lip of the outlet opening is thereby quite often designed as an pouring nipple or duct. In the known caps, a tubular or bar-shaped peg is provided on the hinged lid which inserts into the outlet opening in the lid's closed position in order to provide the sealed closure. The hinged lid is raised to the opened position by manual lifting of the lid, whereby the return hinging movement of the hinged lid is determined by the hinged connection between the cap body and the hinged lid.

Cap lids of this type, however, have the disadvantage that the closure mechanism does not provide the same sealing functionality with all substances with which the receptacles can be filled, in particular when the same force is always to be applied for the opening of the hinged lid. In the known caps, the efficiency of the sealing between the lip of the outlet opening and the peg extension when inserted in the closed position is namely realized through the appropriate clearance fitting, meaning the cap is then properly and tightly sealed when the peg has a sufficiently tight fitted seat in the outlet opening and fits to fills this surface in completely. Should, however, a receptacle be filled with a substance that has a lubricating effect, after the hinged lid has been opened and some substance poured out for the first time, the peg will no longer have a tightly fitted seat in the outlet opening. The hinged lid will henceforth open with a substantially less amount of effort required as should be necessary for a secure closure. The hinged lid can consequently be easily opened inadvertently, with subsequent loss of the substance from the receptacle. The known caps do not ensure a sufficiently good sealing effect.

Another possibility for closing the outlet opening is shown for example in European patent application EP 0 629 560 A2. The outlet opening in this cap is not closed by means of a peg being inserted into the outlet opening, but rather the pouring nipple or duct formed by the lip of the outlet opening is covered by a cup-shaped profile mounted on the hinged lid. In the hinged lid's closed position, the cup-shaped profile is nudged over the pouring nipple or duct with such an ample clearance fitting that it seats tightly there-upon and completely fills in the pouring nipple or duct. But the same problems arise here concerning lubricative substances as have been thoroughly described above.

Additionally, the cap according to European patent application EP 0 629 560 A2 should represent an improvement as regards the opening and closing functions of the hinged lid relative to the cap body. For this purpose, an elastic element comprised of rubber-like elastic material is disposed on the hinge between the cap body and the hinged lid. This element exerts a restoring effect on the hinged lid in order to automatically bring it into its opened position when the locking mechanism thereto provided is released. The hinge is thereby formed in the contact surface area between the cap body and the hinged lid, and in particular by a bent edge along a curved or band- like section of lower material strength. On the one hand, compressed elastic elements are hereby provided on the cap body as well as on the hinged lid adjacent the variety of depressions formed on the hinge for the purpose of receiving the hinge in opened state. One end of such an elastic element can thereby be fitted either to the cap body or to the hinged lid. Upon closing the cover, the free end moves into the allocated depression. In the closed position, consequently, the elastic element is then deformed in the compressed surface contact area of the hinge. On the other hand, alternatively, an elastic element in the form of a deformable buffer is provided on the cap body which is then compressed by the hinged lid upon closing.

While this known cap body can admittedly be molded together with the hinged lid as one integral piece, the elastic element must be positioned subsequently and can loosen, come off and become lost when using the cap. Furthermore, in order to induce the desired restoring effect, the elastic element has to have a relatively complicated configuration. In order to position the elastic elements, a series of additional depressions of precisely accurate shape are required on the cap body and on the hinged lid. This makes manufacture relatively complicated and expensive.

SUMMARY OF THE INVENTION

The present invention provides an improved hinged container cap. It is an object of the present invention to provide, with relatively low manufacturing expenditure, a hinged cap which can guarantee a sufficient leakproof sealed closure of the outlet opening regardless of the strength necessary to be applied for its opening or the medium contained within the receptacle. In addition, caps in accordance with the present. invention should distinguish themselves by providing ideal manipulation of a sturdy configuration.

Accordingly, a cap in accordance with the invention provides for at least a raised portion being made of an elastically deformable material. In the closed position, the hinged lid tightly fits to at least the lip of the outlet opening and exerts pressure in the direction of closure on the raised portion. Consequently, the raised portion acts as a sealing means for providing a leakproof closure of the outlet opening. In collaboration with the locking arrangement, this ensures that the hinged lid always exerts a consistent pressure on the outlet opening, whereby any lubricating medium which may be in the receptacle will not have any influence on sealing effectiveness. The locking arrangement fixes the hinged lid in closed position. To open the hinged lid, the locking arrangement must only be released so that no further pressure will be exerted on the raised portion and the dispenser opening for the contents will be cleared.

The raised portion can have a round or an oval base surface and taper in somewhat of a funnel shape to the outlet opening. It is also possible that the raised portion is curved outwardly.

The hinged lid is also formed to curve outwardly and its inner wall tightly seals the outlet opening in the closed position. The hinged lid therefore requires no additional sealing arrangements in order to close the outlet opening.

However, an especially good sealing effect and simultaneously a centering help for the lid can be created in that the hinged lid is provided with a projection on its inner wall facing the outlet opening which at least partially lodges in the outlet opening in closed position. Additionally or alternatively, the projection can tightly fit the lip of the outlet opening, whereby the lip of the outlet opening, and if necessary the raised portion, are elastically deformed.

In an advantageous aspect of the invention, the hinged closure or the cap is realized as a one-handed hinged cap.

The present invention further provides a hinged cap having an additional operative element on the hinged connection consisting of an elastically deformable material which creates a biasing force between the cap body and the hinged lid in order to bring the hinged lid into an opened position and which, upon manual closing of the hinged lid, is elastically deformed between cap body and hinged lid.

An especially advantageous further aspect provides for enabling manipulation of the hinged cap with only one hand by providing an operative elastically deformable element on the hinged connection between the cap body and the hinged lid. Said element creates a biasing force between the cap and the hinged lid in order to bring the hinged lid into an opened position. Upon manual closing of the hinged lid, the elastic element between the cap body and the hinged lid is elastically deformed. After the locking arrangement has been manually released, the hinged lid consequently automatically pops up into the opened position as a result of the force predetermined by the elastic element.

In accordance with another basic aspect of the invention, the hinged connection between the cap body and the hinged lid is formed from a band-like connecting piece_or from a plurality of connecting brackets. In this case, the elastic element is solidly molded on one side of the band-like connecting piece, or respectively between the connecting brackets. The elastic element is therefore solidly fixed to the joint so that it cannot involuntarily disengage. The construction of this hinging mechanism is relatively simple. and not "fissured," thereby excluding to a large extent that the medium contained in the receptacle will jam up in the depression or in the raised portion of the hinged connection, which would thereby adversely impair the functionality.

The locking arrangement, also in accordance with an even further basic idea of the invention, can be formed as a manually releasable snap-lock cap, whereby the hinged lid is provided with a locking projection which, in closed position, clutches rearwards to a biased, manually operable locking element which is disposed on the cap body in a section formed from an elastically deformable material. The locking arrangement is especially simple to use in that only a light pressure must be manually applied to the elastic section formed on the cap body's exterior wall in order to disengage the locking element from the locking projection. An especially good functionality is thereby guaranteed since the cap body itself is not distorted, but rather only the elastic portion. A tightly fitted seat of the cap is thereby always ensured.

In an especially advantageous aspect, a downwardly extending tongue is provided at the hinged lid's lip section having an inward or outward extending locking projection. In closed position, the locking projection clutches rearwards to a biased inwardly or outwardly extending locking element in an elastically deformable section of the cap body in the manner of a snap-lock cap. The locking element is released from its engagement with the locking projection of the tongue upon manual pressure applied to the elastically deformable area.

In order to attain an especially flat outer cap surface, in particular so that no functional components of the locking arrangement project, the downwardly extending tongue can extend rearwards into a recess on or within the outer wall of the cap body when in closed position. The elastically deformable area can thereby be formed within the recess and be provided with a control device for the releasing of the locking arrangement.

In accordance with another particularly accentuated aspect of the invention, the raised portion of the upper boundary wall of the cap body, the elastically deformable element on the hinged connection between the cap body and the hinged lid, and the elastically deformable section of the locking arrangement can be made from a thermoplastic elastomer (TPE) or from silicone. These materials can be processed especially well and provide the necessary elastic deforming qualities required for a tight seal and restoring effect.

In order to be particularly effective in the manufacturing procedure and to realize an extremely compact structure, at least the raised portion of the upper boundary wall of the cap body and the elastically deformable element at the hinged connection between the cap body and the hinged lid may be manufactured as a coherent integral one-piece section made from a thermoplastic elastomer (TPE) or silicone.

An especially compact and easily manufactured construction is enabled in accordance with the present invention in that a TPE film is formed in each of the sections comprised of the thermoplastic elastomer (TPE).

In accordance with the present invention, the one-handed hinged closure, the hinged cap respectively, guarantees a sufficient leakproof closing of the outlet opening regardless of the force applied in order to open it or the medium contained within the receptacle with relatively low manufacture expenditure and good resultant manipulation.

In the following, two embodiments of a cap formed in accordance with the present invention shall be explained in further detail with reference to the accompanying drawings.

DETAILED DESCRIPTION OF PREFERRED EMBODIMENTS

Figure 1:
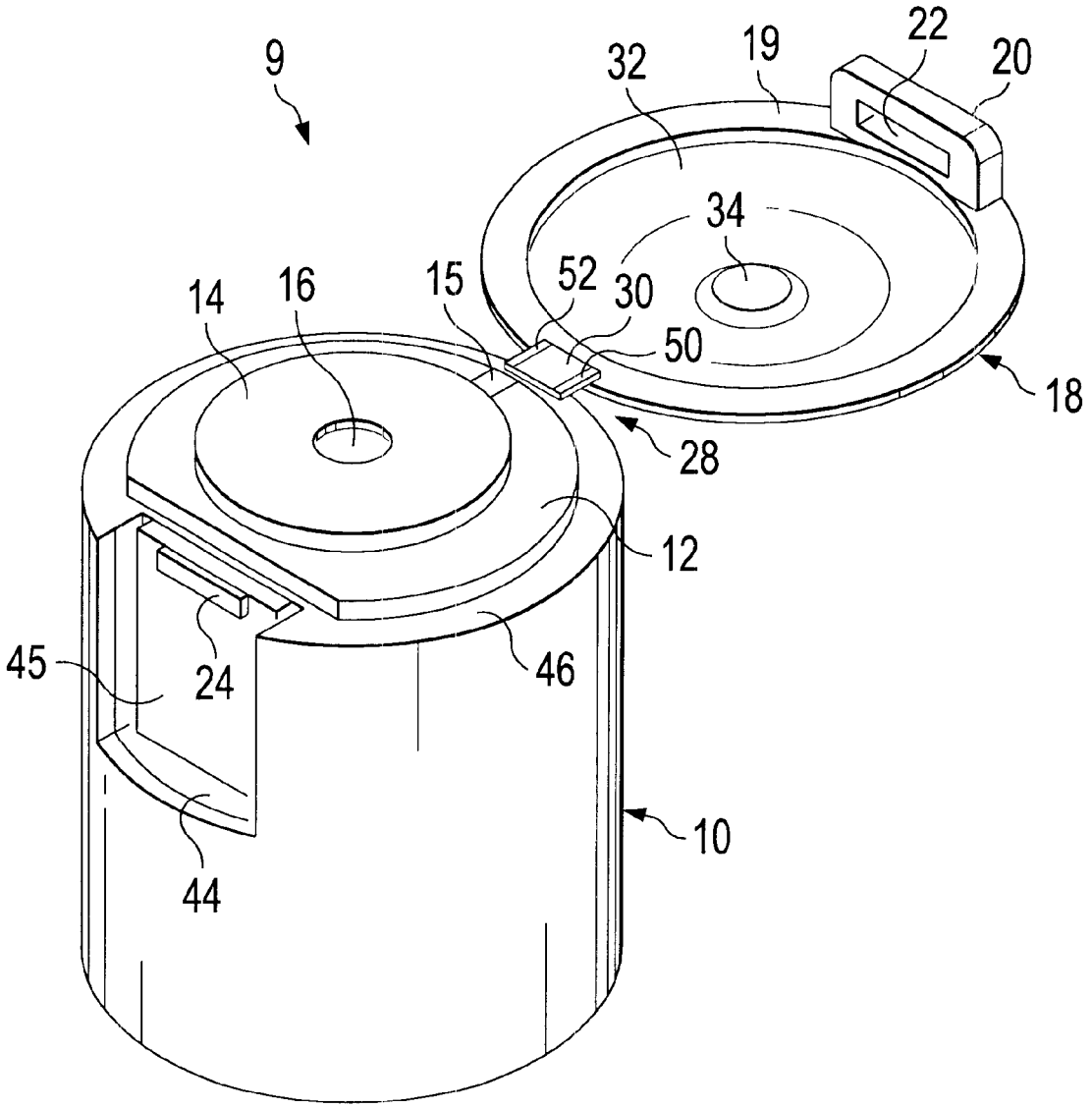
FIG. 1 is a perspective view of one preferred embodiment of the present invention.

The common characterizing features of both embodiments as represented will now be described with reference to FIGS. 1 to 6.

The two caps of the invention are designated by numerals 9 and 9' and both have a cap body 10 with an essentially cylindrical form and circular cross sectional diameter. On the inner wall 11 of cap body 10, visible in FIGS. 3 and 6, a female thread is provided (not shown) which serves to screw the cap body onto a bottle neck (not shown) having a corresponding male thread. A sealing means 13 at the upper inner wall establishes a leakproof sealed connection between the bottle neck and the cap body 10.

A round hinged lid 18 is attached in hinging manner to the cap body 10 by means of a hinged connection 28. Hinged lid 18 is depicted in opened position in FIGS. 1 to 6. The hinged lid 18 is curved outwardly and, in its closed position (not shown), its lower, annular boundary section 19 encloses upper boundary wall 12 of cap body 10. A protruding projection 34, circular in diameter with rounded off edges, is centrally arranged on the curved inner side 32 of hinged lid 18.

The upper boundary wall 12 of cap body 10 is of circular shape and locks in flush alignment with closed hinged lid 18. A circular outlet opening 16 is disposed in the center of circular upper boundary wall 12. A raised portion 14 in said upper boundary wall 12 is concentrically aligned with outlet opening 16. As can be noted from FIGS. 3 and 6, raised portion 14 tapers in a funnel shape to central outlet opening 16.

When hinged lid 18 is in closed position, projection 34 on inner side 32 of hinged lid 18 positions to seal the lip of outlet opening 16.

Figure 2:
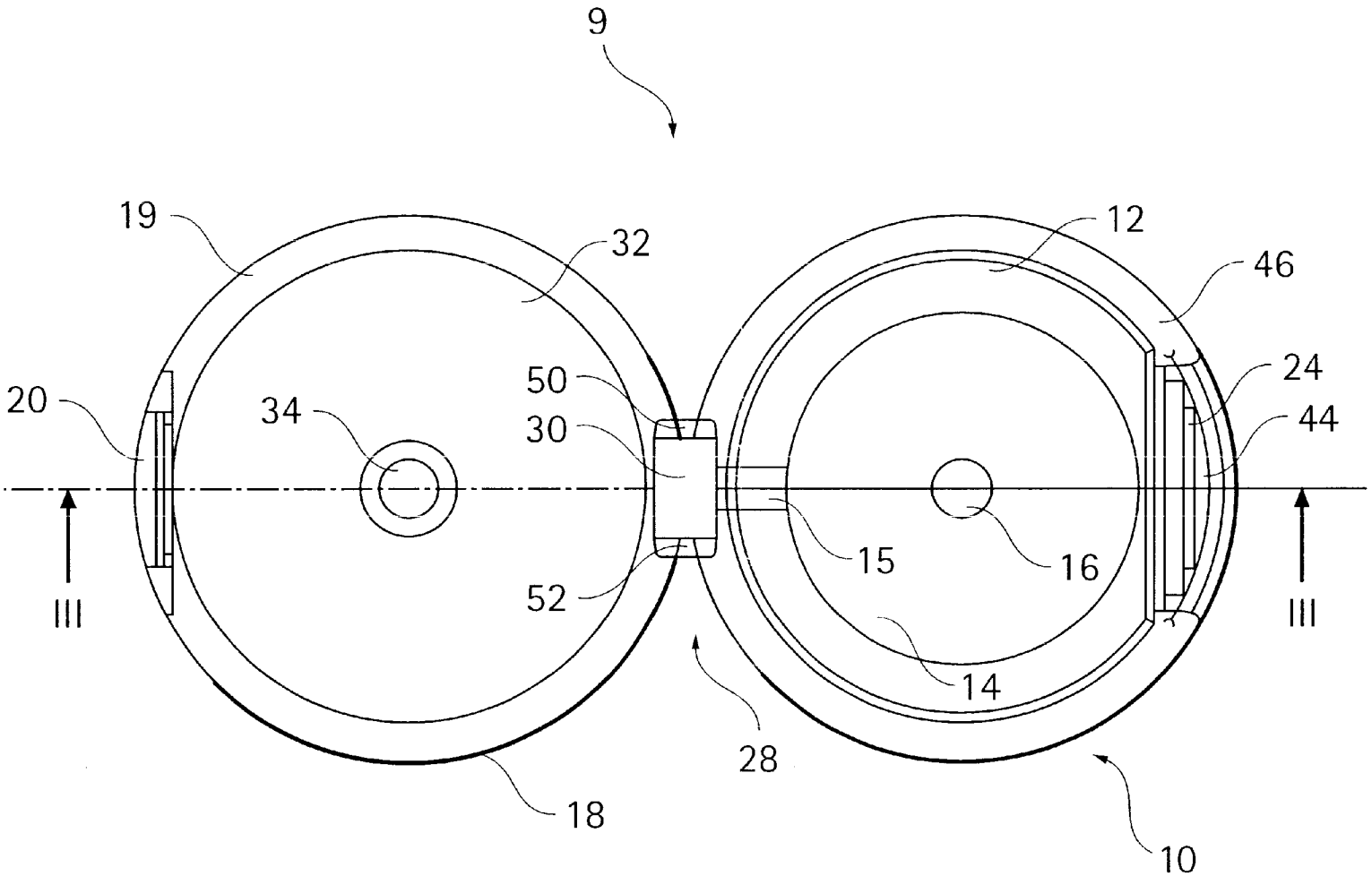
FIG. 2 is a top plan view of the cap shown in FIG. 1.
Figure 5:
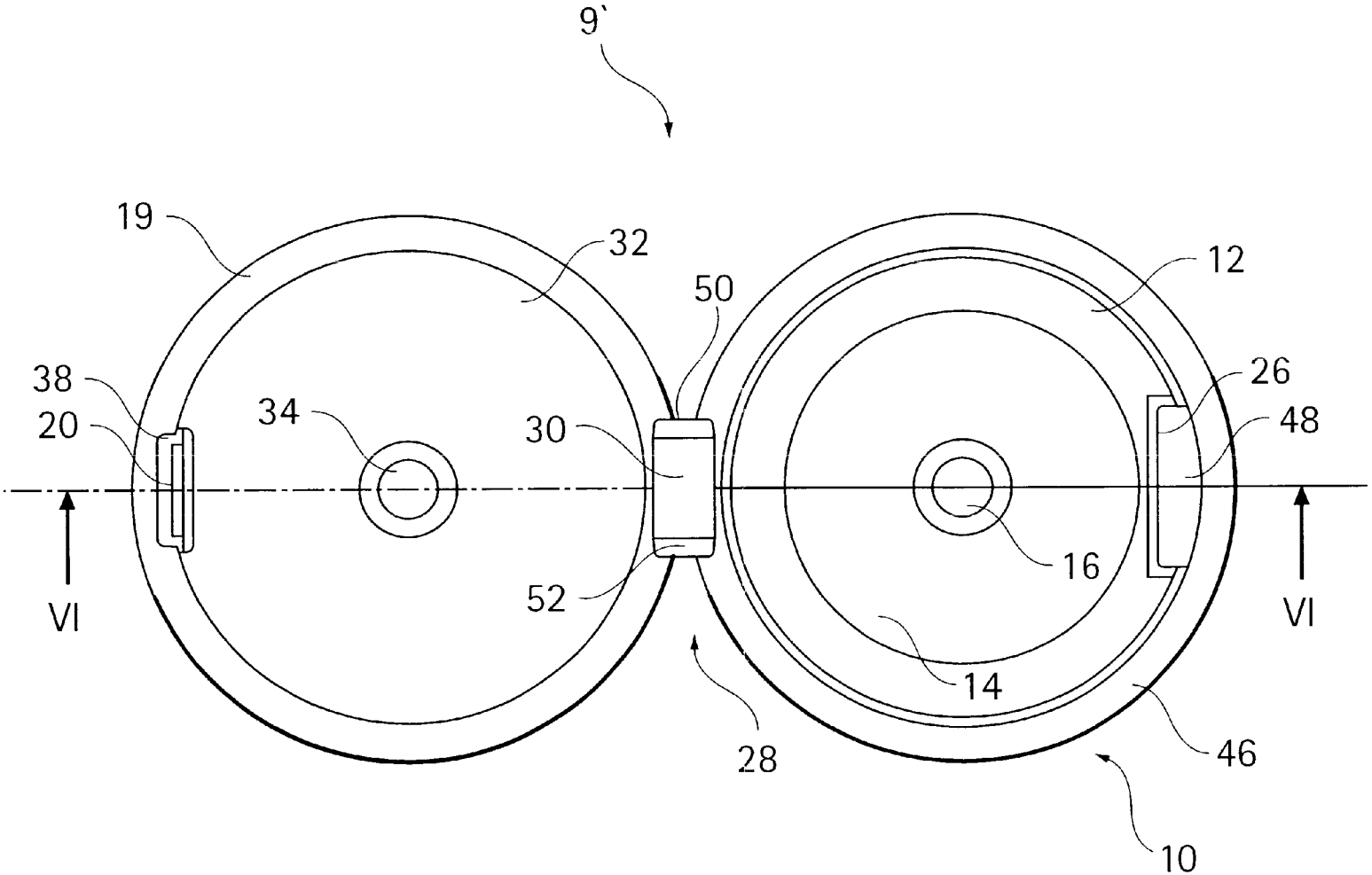
FIG. 5 is a top plan view of the cap shown in FIG. 4.

The hinge connection between cap body 10 and hinged lid 18 is, as is especially clear with reference to FIGS. 2 and 5, formed by two brackets 50 and 52 extending parallel to one another as well as to upper boundary wall 12 of cap body 10. Brackets 50 and 52, together with hinged lid 18 and cap body 10, form an integral unit, meaning hinged lid 18 is formed together with cap body 10 and brackets 50 and 52 disposed therebetween as a single one-piece element made out of polypropylene. In so doing, brackets 50 and 52 are formed with such a low material strength that they will deform upon shutting of the lid closed. An elastically deformable element 30 is arranged between both brackets 50 and 52, represented here in cross-hatched pattern, which generates a biasing force between cap body 10 and hinged lid 18 in order to bring hinged lid 18 into an opened position. Upon manual closing of hinged lid 18, said elastic element 30 between cap body 10 and hinged lid 18 is elastically deformed.

Elastic element 30 is manufactured from a thermoplastic elastomer (TPE). Said elastic element 30 is solidly connected not only with both brackets 50 and 52, but also with cap body 10 and hinged lid 18 in the region close to hinged connection 28. In order to create such a fixed connection, a so-called turnaround procedure is utilized during manufacture. In a first step, cap body 10 and hinged lid 18 are formed together with brackets 50 and 52 out of polypropylene. In the subsequent second step, the form produced is then rotated 180° and a TPE film is applied to the hinge connection section. On the basis of the thermal relationships inherent with this technique, a solid connection is formed between the polypropylene and the TPE film.

The characterizing features of the cap 9 of one preferred embodiment will now be described with reference to FIGS. 1 to 3.

The raised portion 14 on the upper boundary wall 12 of cap body 10 is an elastically deformable section made from TPE. This raised TPE portion 14 can likewise be manufactured from a TPE film by means of the above-mentioned turnaround procedure. So that raised TPE portion 14 and TPE element 30 are technically simple to manufacture, a TPE bracket 15 is formed between raised TPE portion 14 and TPE element 30 on the upper boundary wall 12 of cap body 10. Consequently, raised TPE portion 14 and TPE element 30 are formed together with TPE bracket 15 as a coherent TPE section.

In the closed position (not shown) of hinged lid 18, projection 34 formed on inner side 32 of hinged lid 18 extends at least partially into outlet opening 16 and positions to seal with the lip of outlet opening 16. In so doing, the lip of outlet opening 16 and the raised portion 14 become elastically deformed, resulting in an especially good, efficient sealed connection.

Figure 3:
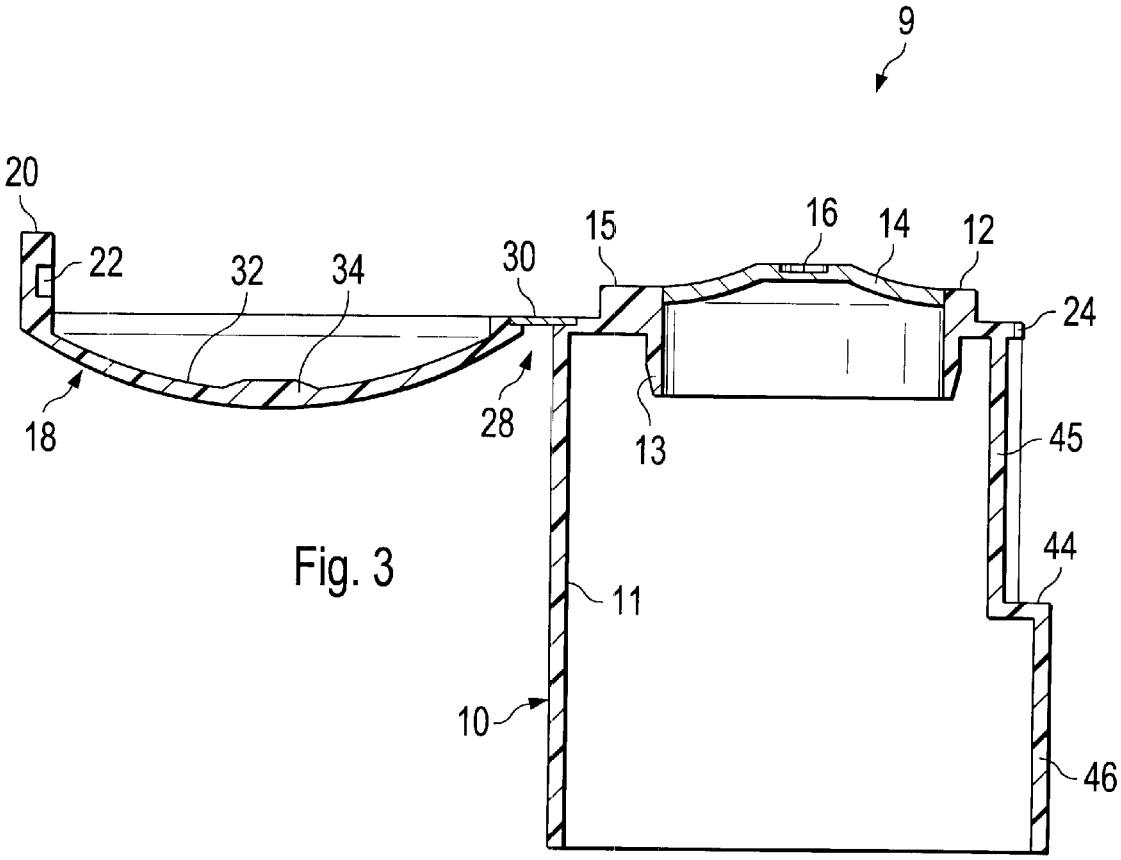
FIG. 3 is a sectional view taken along line III—III of FIG. 2.

Lip section 19 of hinged lid 18 is provided with a tongue 20 which extends downwardly in the closed position and has an inwardly extending locking projection 22, FIG. 3. In the closed position, said locking projection 22 clutches rearwards in the manner of a snap-lock closure to an outwardly extending locking element 24 which is formed within a rectangular recess 44, 45 on the outer wall 46 of cap body 10. To raise hinged lid 18, tongue 20, which is made out of polypropylene and has a certain elastic deformability, is manually pulled in an upward direction whereby locking projection 22 is released and hinged lid 18 opens.

Figure 4:
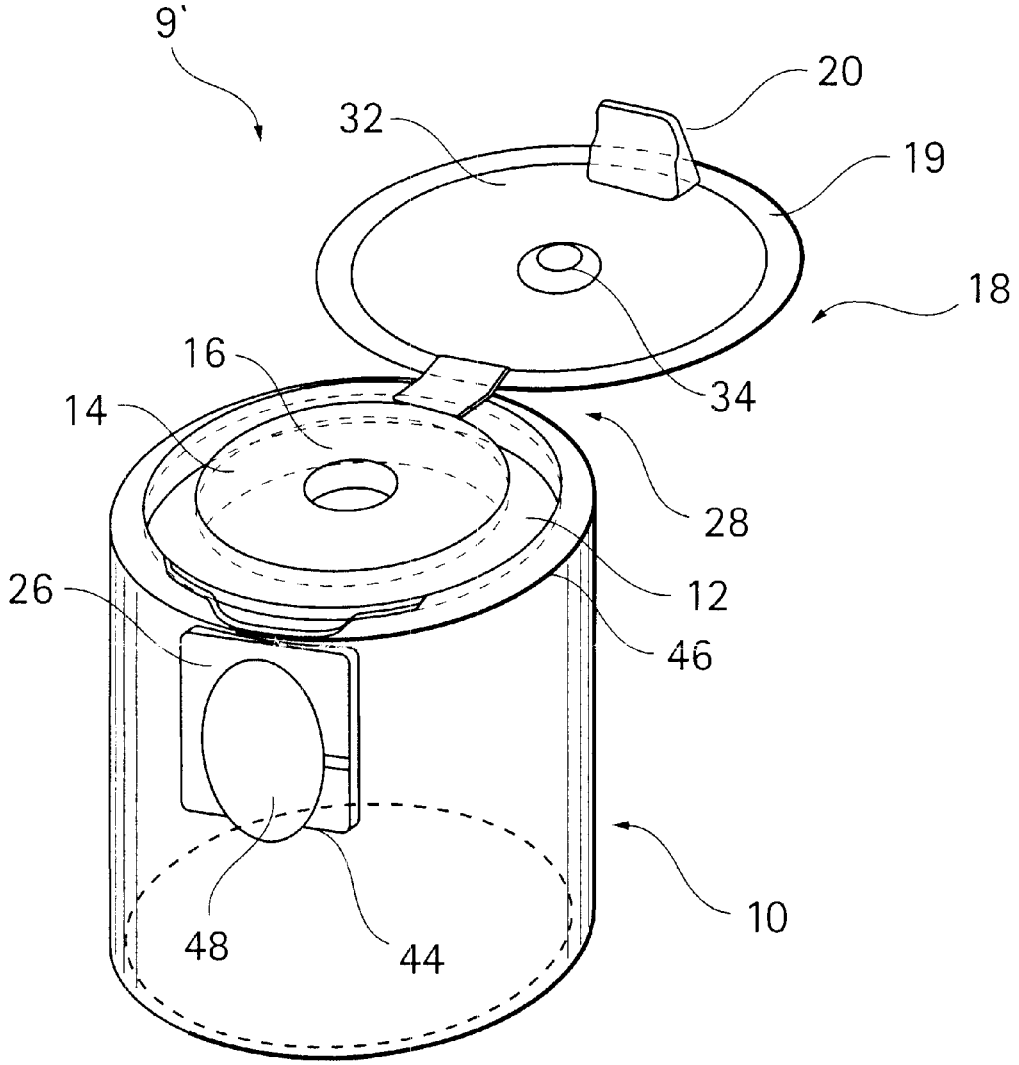
FIG. 4 is a perspective view of an alternate embodiment of a cap in accordance with the present invention.
Figure 6:
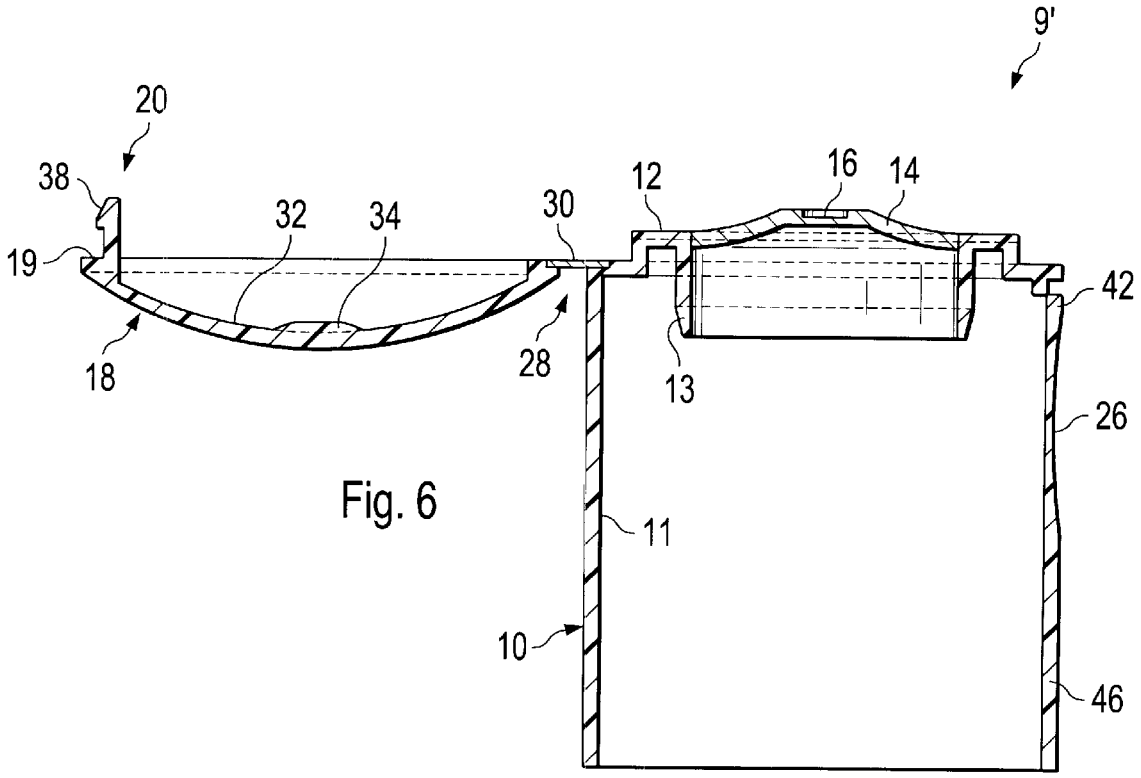
FIG. 6 is a sectional view taken along line VI—VI of FIG. 5.

The characterizing features of the cap 9' of an alternate embodiment will now be described with reference to FIGS. 4 to 6.

Lip section 19 of hinged lid 18 is provided with a tongue 20 which extends downwardly and has an outwardly extending locking projection 38. In the closed position (not shown), said locking projection 38 clutches rearwardly in the manner of a snap-lock closure to a biased inwardly extending locking element 42 which is arranged in a somewhat rectangular recess 44 on the outer wall 46 of cap body 10 and into which tongue 20 extends. An elastically deformable section 26 is formed within recess 44, which in turn is made from TPE. In the lower part of said TPE section, a control device 48 is arranged, while the locking element 42 is disposed at its upper part. Upon manual pressure being applied to control device 48, locking projection 38 releases tongue 20 from locking element 42 and the TPE elements in hinged area 28 yield an automatic opening of hinged lid 18.

Although preferred embodiments of the invention have been described in detail herein, those skilled in the art will recognize that various substitutions and modifications may be carried out without departing form the scope and spirit of the appended claims.

What is claimed is:

1. A hinged cap including:

a cap body formed for providing a leakproof seal with a receptacle opening, said cap body having an upper boundary wall, a raised portion with an outlet opening arranged therein for a medium contained within the receptacle, wherein the receptacle opening is arranged at the upper boundary wall of the cap body substantially in the center of the upper boundary wall;

a hinged lid connected by a hinge to said cap body for closing of said outlet opening;

locking means disposed on said cap body) and on said hinged lid wherein at least said raised portion is made from an elastically deformable material, and said hinged lid positions tightly against at least a lip of said outlet opening in the closed position of said hinged lid and exerts pressure on said raised portion in the direction of closure; and an elastically deformable element for generating a biasing force between said cap body and said hinged lid in order to bring said hinged lid into an open position, wherein said elastically deformable element is elastically deformed between said cap body and said hinged lid upon manual closing of said hinged lid and said biasing force automatically pops said hinged lid into the open position when said locking means is manually released.

2. A hinged cap comprising:

a cap body formed for providing a leakproof seal with a receptacle opening, said cap body having an upper boundary wall, a raised portion with an outlet opening arranged therein for a medium contained within the receptacle;

a hinged lid connected by a hinge with said cap body foreclosing said outlet opening, a locking arrangement disposed on said cap body and on said hinged lid;

an operative element of elastically deformable material provided on a hinge connection which generates a biasing force between said cap body and hinged lid in order to bring said hinged lid into an open position, and which is elastically deformed between said cap body and said hinged lid upon manual closing of said hinged lid; and said locking arrangement includes a locking projection on said hinged lid which clutches rearwards in a closed position in the manner of a snap-lock closure, and a locking element is arranged on said cap body in a section formed by elastically deformable material, and the hinged lid automatically pops up into the open position as a result of the force predetermined by the elastic element, when the locking arrangement has been manually released.

3. A hinged cap comprising:

a cap body formed for providing a leakproof seal with a receptacle opening, said cap body having an upper boundary wall, a raised portion with an outlet opening arranged therein for a medium contained within the receptacle;

a hinged lid connected by a hinge with said cap body for closing said outlet opening, a locking arrangement disposed on said cap body and on said hinged lid;

an operative element of elastically deformable material provided on said hinged connection which generates a biasing force between said cap body and said hinged lid in order to bring said hinged lid into an opened position, and which is elastically deformed between said cap body and said hinged lid upon manual closing of said hinged lid; and said locking arrangement includes a locking projection on said hinged lid which clutches rearwards in a closed position in the manner of a snap-lock closure, and a locking element is arranged on said cap body in a section formed by elastically deformable material, wherein said hinged lid automatically pops up into the open position as a result of said biasing forced when said locking arrangement is manually released.

4. A hinged cap according to claim 3, wherein:

said tongue, in a hinged lid closed position, extends into a recess on or within an outer wall of said cap body.

5. A hinged cap according to claim 4, wherein:

said elastically deformable section is formed within said recess.

6. A hinged cap according to claim 5, wherein:

a control device is arranged on said elastically deformable section for the releasing of the locking arrangement.

7. A hinged cap according to claim 2, wherein:

at least said raised portion is made from an elastically deformable material, and said hinged lid positions tightly against at least said lip of said outlet opening in a closed position and exerts pressure on said raised portion in the direction of closure.

8. A hinged cap according to claim 7, wherein:

said raised portion has one of a round or oval base surface and tapers in somewhat of a funnel shape to said outlet opening.

9. A hinged cap according to claim 8, wherein:

said raised portion is outwardly curved.

10. A hinged cap according to claim 9, wherein:

said hinged lid is formed with an outward curve and its inner wall tightly seals said outlet opening in a closed position.

11. A hinged cap according to claim 10, wherein:

said hinged lid has a projection on its inner wall facing said outlet opening which, in a closed position of said hinged lid, extends at least partially into said outlet opening and positions tightly against a lip of said outlet opening, whereby said lip of said outlet opening and said raised portion are elastically deformed.

12. A hinged cap according to claim 11, wherein:

at least said raised portion and said elastically deformable element on said hinged connection between said cap body and said hinged lid and said elastic deformable section of said locking arrangement are formed of one of a thermoplastic elastomer (TPE) or silicone.

13. A hinged cap according to claim 12, wherein:

at least said raised portion and said elastically deformable element on said hinged connection between said cap body and said hinged lid form a coherent one-piece section made from one of thermoplastic elastomer (TPE) or silicone.

14. A hinged cap according to claim 13, wherein:

said sections made of thermoplastic elastomer (TPE) are each formed from a TPE film.

15. A hinged cap according to claim 14, wherein:

said section made from a material selected from the group consisting of thermoplastic elastomer (TPE) silicone is formed from a TPE film.

* * * * *

UNITED STATES PATENT AND TRADEMARK OFFICE

CERTIFICATE OF CORRECTION

PATENT NO. : 6,409,034 B2
DATED : June 25, 2002
INVENTOR(S) : Schorner

It is certified that error appears in the above-identified patent and that said Letters Patent is hereby corrected as shown below:

Title page,
Item [73], Assignee, should read -- Kunststoffwerk Kutterer GmbH & Co. (DE) --

Signed and Sealed this

Nineteenth Day of November, 2002

*Attest:*

*Attesting Officer*

JAMES E. ROGAN
*Director of the United States Patent and Trademark Office*